US011293384B2

(12) United States Patent
Kakichi et al.

(10) Patent No.: US 11,293,384 B2
(45) Date of Patent: Apr. 5, 2022

(54) ENGINE

(71) Applicant: Yanmar Power Technology Co., Ltd., Osaka (JP)

(72) Inventors: Yuki Kakichi, Osaka (JP); Shohei Sasaki, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 17/286,410

(22) PCT Filed: Aug. 21, 2019

(86) PCT No.: PCT/JP2019/032682
§ 371 (c)(1),
(2) Date: Apr. 16, 2021

(87) PCT Pub. No.: WO2020/079950
PCT Pub. Date: Apr. 23, 2020

(65) Prior Publication Data

US 2021/0396188 A1 Dec. 23, 2021

(30) Foreign Application Priority Data

Oct. 18, 2018 (JP) ..... JP2018-197064

(51) Int. Cl.
*F02M 26/49* (2016.01)
*F02D 41/00* (2006.01)
(Continued)

(52) U.S. Cl.
CPC ..... *F02M 26/49* (2016.02); *F02D 41/0077* (2013.01); *F02D 41/222* (2013.01);
(Continued)

(58) Field of Classification Search
CPC ..... F02M 26/49; F02D 2041/0067
See application file for complete search history.

(56) References Cited

U.S. PATENT DOCUMENTS 4,879,986 A * 11/1989 Sakamoto ..... F02M 26/49 123/676
6,434,476 B1 * 8/2002 Zagone ..... F02D 41/222 123/568.16
6,925,804 B2 * 8/2005 Longnecker ..... F02M 26/49 60/602
(Continued)

FOREIGN PATENT DOCUMENTS

JP H01-056953 A 3/1989
JP 1-159454 A 8/1989
(Continued)

OTHER PUBLICATIONS

International Search Report dated Oct. 1, 2019 issued in corresponding PCT Application PCT/JP2019/032682.

*Primary Examiner* — Kevin R Steckbauer
(74) *Attorney, Agent, or Firm* — Norton Rose Fulbright US LLP

(57) ABSTRACT

This engine includes an EGR device. The engine is provided with: an EGR gas temperature sensor; an EGR valve; an EGR control unit; an EGR valve position detection unit; a diagnosis unit; a first timer; a second timer; and a diagnosis control unit. The diagnosis unit diagnoses whether the EGR gas temperature sensor has failed, on the basis of a detected value from the EGR gas temperature sensor. The first timer, when the EGR valve is open, performs counting in accordance with the passage of time. The second timer, if a count value of the first timer is greater than or equal to a first threshold value set in advance, and if a predetermined condition is satisfied, performs counting in accordance with the passage of time. The diagnosis control unit prohibits diagnosis by the diagnosis unit if a count value of the second timer is less than a second threshold value set in advance, and permits the diagnosis if the count value is greater than or equal to the second threshold value.

7 Claims, 6 Drawing Sheets

(51) Int. Cl.

| | |
|---|---|
| ***F02M 26/13*** | (2016.01) |
| ***F02M 26/47*** | (2016.01) |
| ***F02M 26/48*** | (2016.01) |
| ***F02M 26/33*** | (2016.01) |
| ***F02D 41/22*** | (2006.01) |
| *F02M 26/00* | (2016.01) |

(52) U.S. Cl.
CPC ..... *F02M 26/13* (2016.02); *F02M 26/33* (2016.02); *F02M 26/47* (2016.02); *F02M 26/48* (2016.02); *F02D 2041/0067* (2013.01); *F02D 2200/0614* (2013.01); *F02M 2026/004* (2016.02)

(56) References Cited

U.S. PATENT DOCUMENTS

| | | | | |
|---|---|---|---|---|
| 7,251,555 | B2 * | 7/2007 | Kimura | F02M 26/48 123/568.12 |
| 7,983,834 | B2 * | 7/2011 | Blumendeller | F02M 26/25 701/114 |
| 9,026,399 | B2 * | 5/2015 | Nagoshi | F02D 41/222 702/183 |
| 9,410,494 | B2 * | 8/2016 | Michel | F02M 26/33 |
| 9,534,968 | B2 * | 1/2017 | Nakano | G01K 15/007 |
| 2005/0066658 | A1 * | 3/2005 | Longnecker | F02D 41/222 60/602 |
| 2006/0196485 | A1 * | 9/2006 | Kimura | F02M 26/48 123/568.16 |
| 2009/0038593 | A1 * | 2/2009 | Blumendeller | F02M 26/25 123/568.12 |
| 2011/0251825 | A1 * | 10/2011 | Nagoshi | F02D 41/222 702/183 |
| 2013/0124070 | A1 * | 5/2013 | Michel | F02D 35/028 701/105 |
| 2014/0288801 | A1 * | 9/2014 | Sasaki | F02M 26/28 701/102 |

FOREIGN PATENT DOCUMENTS

| | | | |
|---|---|---|---|
| JP | 1990-022658 | U | 2/1990 |
| JP | H08-026822 | B2 | 3/1996 |
| JP | 2002-147289 | A | 5/2002 |

* cited by examiner

ENGINE

CROSS REFERENCES TO RELATED APPLICATIONS

This application is a national stage application pursuant to 35 U.S.C. § 371 of International Application No. PCT/JP2019/032682, filed on Aug. 21, 2019, which claims priority under 35 U.S.C. § 119 to Japanese Patent Application No. 2018-197064, filed on Oct. 18, 2018, the disclosures of which are hereby incorporated by reference in their entireties.

TECHNICAL FIELD

The present invention relates to an engine. Specifically, the present invention relates to an engine including an EGR device that recirculates a part of an exhaust gas to an intake side as an EGR gas.

BACKGROUND ART

Conventionally, an engine in which an EGR device that recirculates a part of an exhaust gas to an intake side is provided and the EGR device is used to recirculate a part of the exhaust gas (EGR gas) with a low oxygen concentration to thereby intake air to lower a combustion temperature and reduce the amount of NOx (nitrogen oxide) in the exhaust gas is known. In this type of engine, a temperature sensor that detects a temperature is provided in an EGR passage in order to detect an introduction state of the exhaust gas to the intake side. This makes it possible to monitor whether an abnormality has occurred in an operation of EGR.

In order to prevent erroneous determination regarding normal/abnormal EGR operation, a configuration for diagnosing whether the temperature sensor has a failure has also been conventionally proposed. Each of Patent Documents 1 and 2 discloses a failure detection device for an EGR temperature sensor.

A failure detection device of an EGR temperature sensor of Patent Document 1 determines a state where an exhaust gas is not introduced from an exhaust pipe side to an intake pipe side via an EGR valve provided in an EGR communication pipe. The failure detection device is configured to detect that the EGR temperature sensor has a failure if the temperature detected by the EGR temperature sensor is high when it is determined that the exhaust gas is not introduced on the intake pipe side.

Unlike Patent Document 1, a failure diagnosis device for an exhaust gas recirculation device of Patent Document 2 performs a failure diagnosis of a temperature sensor in a state where an exhaust gas is recirculated by EGR. However, Patent Document 2 points out that, in the temperature sensor, such as a thermistor, a response is delayed in detecting a temperature in some cases. In consideration of this response delay, the failure diagnosis device of the exhaust gas recirculation device of Patent Document 2 detects a gas temperature by the sensor in a state where an area to which EGR is applied continues for a predetermined time and diagnoses a failure, based on this detected value.

CITATION LIST

Patent Literature

Patent Document 1: Japanese Examined Patent Publication No. Hei. 8-26822

Patent Document 2: Japanese Unexamined Patent Application Publication No. Hei. 1-056953

DISCLOSURE OF INVENTION

Problems to be Solved by the Invention

The temperature detected by the EGR gas temperature sensor is affected by a delay in response of the sensor itself described in Patent Document 2 and the fact that it takes time for the temperature in the EGR gas passage to rise sufficiently after the EGR operation is started. Therefore, especially when the engine is cold-started (when the engine is started under a condition where an outside air temperature is low or like condition), the presence or absence of failure of the EGR gas temperature sensor could not be appropriately determined based on the detected temperature only by considering the response delay of the sensor itself, and there was a risk of making an erroneous diagnosis.

The present invention has been made in view of the foregoing, and it is an object of the present invention to provide an engine capable of accurately performing diagnosis of an EGR gas temperature sensor.

Means For Solving The Problems And Effect Of The Invention

The problems to be solved by the present invention is as described above, and the solutions to the problem and the advantages of the solution will be described below.

According to the viewpoint of the present invention, an engine having the following configuration is provided. That is, the engine includes an EGR device that recirculates a part of an exhaust gas to an intake side as an EGR gas. The engine includes an engine body, an EGR passage, an EGR gas temperature sensor, an EGR valve, an EGR control unit, an EGR valve opening degree detection unit, a diagnosis unit, a first timer, a second timer, and a diagnosis control unit. The engine body includes an exhaust passage and an intake passage. The EGR passage connects the exhaust passage and the intake passage so that the EGR gas can be distributed. The EGR gas temperature sensor detects a temperature of the EGR gas flowing through the EGR passage. The EGR valve can adjust an amount of the EGR gas flowing through the EGR passage by changing an opening degree. The EGR control unit controls the opening degree of the EGR valve. The EGR valve opening degree detection unit detects the opening degree of the EGR valve. The diagnosis unit diagnoses whether the EGR gas temperature sensor has a failure, based on a value detected by the EGR gas temperature sensor. The first timer performs counting in accordance with passage of time when the EGR valve is open. The second timer performs counting in accordance with the passage of time when a count value of the first timer is equal to or more than a preset first threshold and predetermined conditions are satisfied. The diagnosis control unit blocks a diagnosis by the diagnosis unit when a count value of the second timer is less than a preset second threshold and permits the diagnosis when the count value of the second timer is larger than or equal to the second threshold.

Thus, by using the first timer that indicates the degree of warm-up by the EGR gas with respect to a configuration around the EGR gas temperature sensor in the EGR passage, diagnose can be performed by the EGR gas temperature sensor at an appropriate timing properly considering a time required for the warm-up. In addition, by setting that the count value of the first timer is equal to or more than a predetermined threshold as one of conditions for counting of the second timer, it is possible to determine a timing of the diagnosis while considering various determination factors in a well-balanced manner. As a result, a diagnosis of the EGR gas temperature sensor can be accurately performed.

The engine preferably has the following configuration. That is, the engine includes an exhaust side temperature detection unit that detects an internal temperature of a portion of the exhaust passage on an upstream side of a connection portion with the EGR passage. The predetermined conditions are based on at least the opening degree of the EGR valve and the temperature detected by the exhaust side temperature detection unit.

Thus, the diagnosis of the EGR gas temperature sensor can be performed in a state where the temperature of the EGR gas in the EGR passage is high and a flow rate of the EGR gas is sufficient. Therefore, accuracy of the diagnosis of the EGR gas temperature sensor can be improved.

In the engine, when the opening degree of the EGR valve is equal to or less than a preset third threshold, the first timer preferably performs reverse counting in accordance with the passage of time.

That is, if the warm-up by the EGR gas becomes insufficient after the EGR passage is warmed up once, the configuration around the EGR gas temperature sensor may be cooled. In this case, by rewinding the count value of the first timer, a diagnostic timing of the EGR gas temperature sensor can be delayed by appropriately considering progress of reduction in temperature.

It is preferable that, in the engine, when the opening degree of the EGR valve is equal to or less than the third threshold, the EGR valve is fully closed.

Thus, the diagnostic timing of the EGR gas temperature sensor can be appropriately delayed when warm-up by the EGR gas is practically stopped for the EGR passage.

The engine preferably has the following configuration. That is, a fourth threshold that is a value closer to an initial value of the first timer than the first threshold related to the first timer is set. When the count value of the first timer is a value closer to the initial value than the fourth threshold, the count value of the first timer is returned to the initial value.

Thus, if a situation where warm-up by the EGR gas is insufficient continues and a configuration around the EGR passage has been cooled for a long time, it is considered that the warm-up has not been performed at all, and thus, a diagnosis of the EGR gas temperature sensor can be kept from being performed in a too early timing. On the other hand, for example, when a short-time EGR cut that does not lower the temperature of the EGR gas is executed at the time of a predetermined change in an operating state of the engine (for example, when accelerating or when a load is applied), it is possible to prevent the diagnostic timing of the EGR gas temperature sensor from being excessively delayed.

In the engine, when the count value of the first timer is a value closer to the initial value than the fourth threshold, the count value of the second timer is preferably returned to an initial value of the second timer.

Thus, if a situation where the warm-up by the EGR gas is insufficient continues and the configuration around the EGR passage has been cooled for a long time, it is considered that a situation where predetermined conditions for a diagnosis of the EGR gas temperature sensor are satisfied did not occur at all, and thus, it is possible to wait in a standby state without performing a diagnosis of the EGR gas temperature sensor until a stabilized situation is achieved. On the other hand, in the case of the short-time EGR cut, or the like, it is possible to prevent the diagnostic timing of the EGR gas temperature sensor from being excessively delayed.

The engine preferably has the following configuration. That is, in order to satisfy the predetermined conditions, it is necessary at least that the opening degree of the EGR valve is equal to or more than a predetermined opening degree and a fuel injection amount is equal to or more than a predetermined injection amount. In a first case where the opening degree of the EGR valve is less than the predetermined opening degree and the fuel injection amount is equal to or more than the predetermined injection amount, the second timer performs reverse counting in accordance with the passage of time. In a second case where the opening degree of the EGR valve is equal to or more than the predetermined opening degree and the fuel injection amount is less than the predetermined injection amount, the second timer performs reverse counting in accordance with the passage of time. A change rate of the count value of the second timer in the second case is larger than a change rate of the count value of the second timer in the first case.

Thus, when the fuel injection amount condition is not satisfied, the count value of the second timer is rewound relatively larger than when the EGR valve opening degree condition is not satisfied. Therefore, the timing of the diagnosis of the EGR gas temperature sensor can be determined with emphasis on the fuel injection amount that is important for increasing the accuracy of an abnormality diagnosis of the EGR gas temperature sensor.

DESCRIPTION OF EMBODIMENTS

Next, an embodiment of the present invention will be described with reference to the accompanying drawings.

Figure 1:
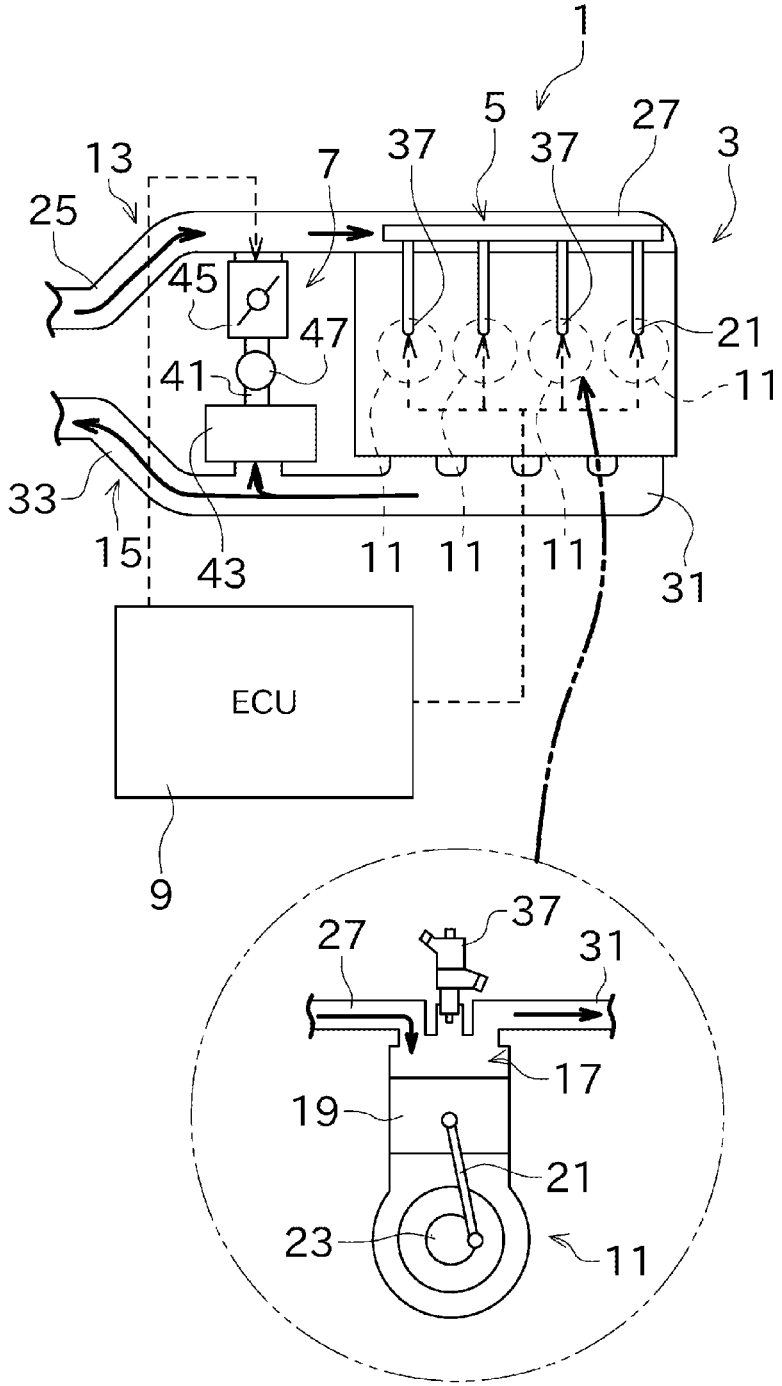
FIG. 1 is a schematic view schematically illustrating a configuration of an engine according to an embodiment of the present invention.
Figure 2:
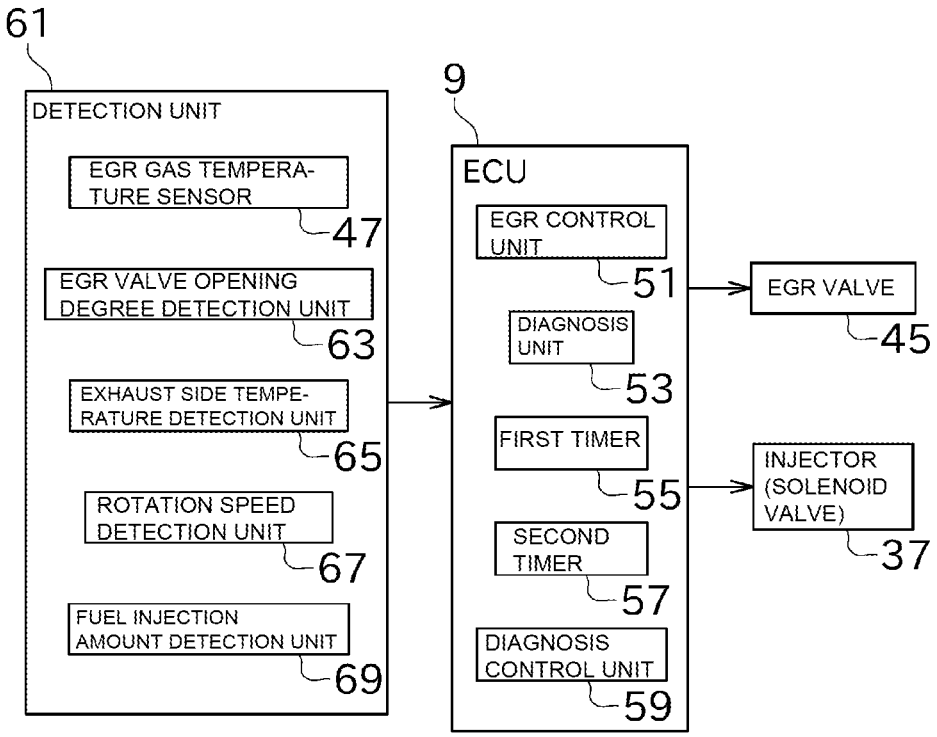
FIG. 2 is a functional block diagram illustrating a configuration of an ECU.

First, an outline of an engine 1 will be described with reference to FIG. 1 and FIG. 2. FIG. 1 is a schematic view schematically illustrating a configuration of the engine 1 according to the embodiment of the present invention. FIG. 2 is a functional block diagram illustrating a configuration of an ECU 9.

The engine 1 is an in-line 4-cylinder diesel engine in this embodiment. As illustrated in FIG. 1, the engine 1 includes an engine body 3, a fuel injection device 5, an EGR device (exhaust gas recirculation device) 7, and an ECU (engine control unit) 9 as an engine control unit.

The engine body 3 includes a cylinder 11, an intake unit 13, and an exhaust unit 15. There are four cylinders 11.

Each of the cylinders 11 is provided with a combustion chamber 17 and a slidable piston 19. The piston 19 is connected to a crankshaft 23 that is an output shaft of the engine 1 via a rod 21.

The intake unit 13 includes an intake passage through which air can flow. The intake passage includes an intake pipe 25 and an intake manifold 27.

The intake pipe 25, together with the intake manifold 27, can inhale air from outside of the engine body 3 into inside (combustion chamber 17) thereof. The intake pipe 25 is connected to the intake manifold 27.

The intake manifold 27 distributes the air from the intake pipe 25 in accordance with the number of cylinders 11 of the engine body 3 and guides the air to the combustion chamber 17 of each of the cylinders 11.

The exhaust unit 15 includes an exhaust passage through which an exhaust gas can be distributed. The exhaust passage includes an exhaust manifold 31 and an exhaust pipe 33.

The exhaust manifold 31 collects the exhaust gas generated in the combustion chamber 17 of each of the cylinders 11 and guides the collected exhaust gas to the exhaust pipe 33.

The exhaust pipe 33 is connected to the exhaust manifold 31. The exhaust pipe 33 discharges the exhaust gas from the exhaust manifold 31 to the outside of the engine body 3.

The fuel injection device 5 includes an injector 37 corresponding to each of the cylinders 11. The fuel pumped by an unillustrated fuel injection pump is distributed to each of the injectors 37 via a common rail (not illustrated).

A solenoid valve of the injector 37 is electrically connected to the ECU 9. The injector 37 injects an appropriate amount of fuel into the combustion chamber 17 at an appropriate timing in accordance with a command value from the ECU 9.

When the fuel is injected into the combustion chamber 17 by the injector 37, compression self-ignition combustion occurs and causes the piston 19 to reciprocate in the cylinder 11. Then, this reciprocating motion of the piston 19 is converted into a rotational motion of the crankshaft 23 via the rod 21.

The EGR device 7 can recirculate a part of the exhaust gas as an EGR gas from an exhaust side (the exhaust passage) to an intake side (the intake passage).

The EGR device 7 includes an EGR tube 41 as an EGR passage, an EGR cooler 43, an EGR valve 45, and an EGR gas temperature sensor 47.

The EGR pipe 41 is arranged so as to recirculate the EGR gas from the exhaust passage to the intake passage. The EGR pipe 41 is provided so as to connect a portion of the exhaust pipe 33 located near the exhaust manifold 31 and the intake pipe 25.

The EGR cooler 43 can cool the EGR gas. The EGR cooler 43 is provided in the middle of a path through which the EGR gas flows in the EGR pipe 41.

The EGR valve 45 can adjust a recirculation amount of the EGR gas. The EGR valve 45 is provided in the middle of the path through which the EGR gas flows in the EGR pipe 41. The EGR valve 45 is arranged in a downstream side of the EGR cooler 43 in an EGR gas recirculation direction.

The EGR valve 45 is electrically connected to the ECU 9. The EGR valve 45 can change the opening degree of the EGR valve 45 in accordance with the command value from the ECU 9.

The EGR valve 45 changes an actual flow path area of the EGR pipe 41 that is a recirculation passage of the EGR gas by changing the opening degree. This allows the EGR valve 45 to adjust how much the EGR gas is to be recirculated.

The EGR gas temperature sensor 47 can detect a temperature of the EGR gas. The EGR gas temperature sensor 47 is provided in the middle of a path through which the EGR gas flows in the EGR tube 41.

The EGR gas temperature sensor 47 is arranged in an upstream side of the EGR valve 45 in the EGR gas recirculation direction. In addition, the EGR gas temperature sensor 47 is arranged in the downstream side of the EGR cooler 43 in the EGR gas recirculation direction.

The ECU 9 is configured to be able to control an operation of the engine 1. In this embodiment, the ECU 9 also functions as an EGR control unit 51 that controls the opening degree of the EGR valve 45.

As illustrated in FIG. 2, the ECU 9 further includes a diagnosis unit 53, a first timer 55, a second timer 57, and a diagnosis control unit 59.

Specifically, the ECU 9 is configured as a known computer and includes a CPU, a ROM, a RAM, a timer circuit, or the like. The CPU executes various arithmetic processes and controls. The ROM and the RAM store various types of information. The ROM stores a program used for diagnosing a failure of the EGR gas temperature sensor 47. Cooperation of the above-described hardware and software can cause the ECU 9 to function as the EGR control unit 51, the diagnosis unit 53, the first timer 55, the second timer 57, the diagnosis control unit 59, and or like.

The diagnosis unit 53 performs a diagnosis of the EGR gas temperature sensor 47 of the EGR device 7 (specifically, an abnormality diagnosis on whether the EGR gas temperature sensor 47 has a failure). Hereinafter, this diagnosis may be referred to as an abnormality diagnosis.

The abnormality diagnosis of the EGR gas temperature sensor 47 can be performed by a known method. Briefly, after starting the engine 1, when the EGR gas temperature sensor 47 is in a sufficiently high temperature environment, the diagnosis unit 53 acquires a detected value of the EGR gas temperature sensor 47. In addition, the detected value of the EGR gas temperature sensor 47 is stored in advance before starting the engine 1 (in a cold state). The diagnosis unit 53 calculates a difference between the two detected values, and if the obtained difference is smaller than a predetermined value, it can be determined that an abnormality has occurred in the EGR gas temperature sensor 47.

The first timer 55 is a count-up timer whose count value is initialized to 0 when the engine 1 is started. The first timer 55 adds a predetermined number to the count value at predetermined time intervals when the opening degree of the EGR valve 45 satisfies a predetermined condition (count-up). In this embodiment, a condition for count-up is that the EGR valve 45 is open even slightly (the opening is not fully closed). On the other hand, if this condition is not met, the first timer 55 subtracts a predetermined number every predetermined time (count-down).

Similar to the first timer 55, the second timer 57 is a count-up timer whose count value is initialized to 0 when the engine 1 is started. The second timer 57 adds a predetermined number to the count value every predetermined time when the count value of the first timer 55 is equal to or more than the predetermined value and the predetermined condition is satisfied (count-up). On the other hand, if this condition is not satisfied, the second timer 57 subtracts a predetermined number every predetermined time (count-down).

In this embodiment, since the first timer 55 is a count-up timer, the normal count is count-up and the reverse count is count-down. Similar applies to the second timer 57.

The diagnosis control unit 59 monitors the count value of the second timer 57. The diagnosis control unit 59 blocks an abnormality diagnosis by the diagnosis unit 53 when the count value of the second timer 57 is less than a predetermined threshold, and permits the abnormality diagnosis by the diagnosis unit 53 when the count value is equal to or more than the predetermined threshold.

The ECU 9 is electrically connected to the detection unit 61 for detecting the operating state of the engine body 3. The ECU 9 acquires various detected values by the detection unit 61 and controls the operation of the engine 1, based on the detected values.

For example, the ECU 9 acquires the temperature of the EGR gas from a value detected by the detection unit 61 and adjusts the opening degree of the EGR valve 45, based on the acquired temperature. This makes it possible to control the recirculation amount of EGR gas.

In addition to the EGR gas temperature sensor 47 described above, the detection unit 61 includes an EGR valve opening degree detection unit 63, an exhaust side temperature detection unit 65, a rotation speed detection unit 67, and a fuel injection amount detection unit 69.

The EGR valve opening degree detection unit 63 detects the opening degree of the EGR valve 45 in accordance with an appropriate method. In this embodiment, the EGR valve opening degree detection unit 63 obtains the opening degree of the EGR valve 45 by calculating the opening degree, based on the command value from the ECU 9 to the EGR valve 45.

However, the EGR valve opening degree detection unit 63 may be configured to detect the opening degree of the EGR valve by, for example, providing a position detection sensor in the EGR valve.

The exhaust side temperature detection unit 65 detects a temperature of a portion of the exhaust passage located on an upstream side of a connection portion between the exhaust pipe 33 and the EGR passage (EGR pipe 41). The exhaust side temperature detection unit 65 can be configured as, for example, a temperature sensor that detects the temperature of the exhaust gas at or near the exhaust manifold 31 in the exhaust passage.

The rotation speed detection unit 67 acquires the rotation speed of the engine 1. The rotation speed detection unit 67 can be configured as, for example, a crank sensor that detects a rotation of the crankshaft 23 of the engine body 3.

The fuel injection amount detection unit 69 detects a fuel injection amount by the fuel injection device 5. The fuel injection amount detection unit 69 can be configured to obtain the fuel injection amount, for example, by calculating the fuel injection amount, based on the command value from the ECU 9 to the solenoid valve provided in the injector 37.

Next, a diagnosis of the EGR gas temperature sensor 47 using the ECU 9 will be described with reference to FIG. 3 and FIG. 4.

Figure 3:
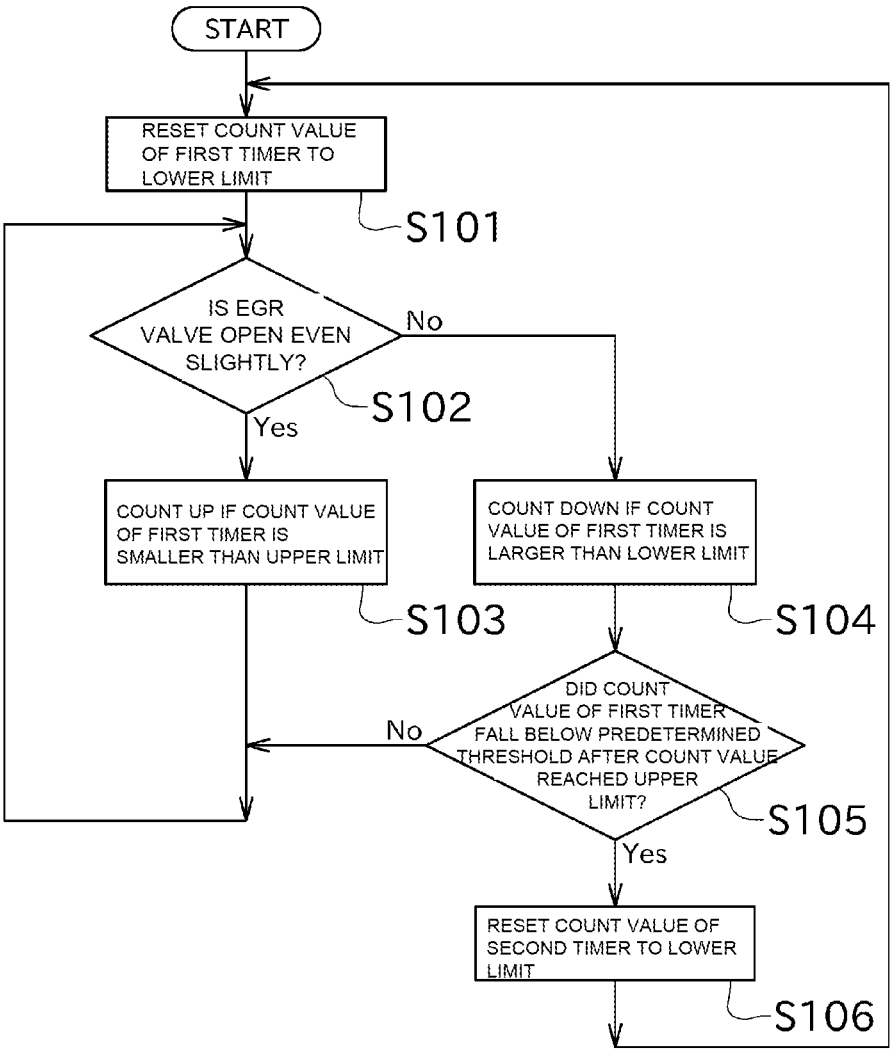
FIG. 3 is a flowchart illustrating a part of processing performed by the ECU for diagnosis of an EGR gas temperature sensor, which is related to a first timer.

FIG. 3 illustrates a flowchart related to processing of the first timer 55. A flow in FIG. 3 is started when the engine 1 is started.

First, the ECU 9 performs initialization processing with the count value of the first timer 55 as a lower limit (Step S101). In this embodiment, the lower limit of the count value of the first timer 55 is 0 and an upper limit is 65535. In Step S101, the count value of the first timer 55 is reset to 0.

Next, the ECU 9 detects the opening degree of the EGR valve 45 by the EGR valve opening degree detection unit 63 and determines whether this valve is open even slightly (Step S102). An appropriate threshold that is slightly larger than the lower limit of the valve opening degree is used for this determination. The threshold corresponds to an open/close determination threshold (third threshold) described later. If it is determined in Step S102 that the EGR valve 45 is open even slightly, the ECU 9 counts up the first timer 55 (Step S103). However, if the count value has already reached the upper limit (65535), the count-up will not be performed. Thereafter, the process returns to Step S102.

If it is determined in Step S102 that the EGR valve 45 is fully closed, the ECU 9 counts down the first timer 55 (Step S104). However, if the count value has already reached the lower limit (0), the count-down will not be performed.

After processing of Step S104, the ECU 9 determines whether the count value of the first timer 55 has once reached the upper limit value (65535) and then has fallen below a predetermined threshold (Step S105). This threshold corresponds to the reset threshold (fourth threshold) described later. When this condition is satisfied, the ECU 9 resets the count value of the second timer 57, which will be described later, to 0 that is an initial value (lower limit value) (Step S106). After that, the process returns to Step S101, and the ECU 9 resets the count value of the first timer 55 to 0, which is the initial value (lower limit value). After the two timers are forcibly reset, the process returns to Step S102. Even if the conditions of Step S105 are not met, the process returns to Step S102.

Figure 4:
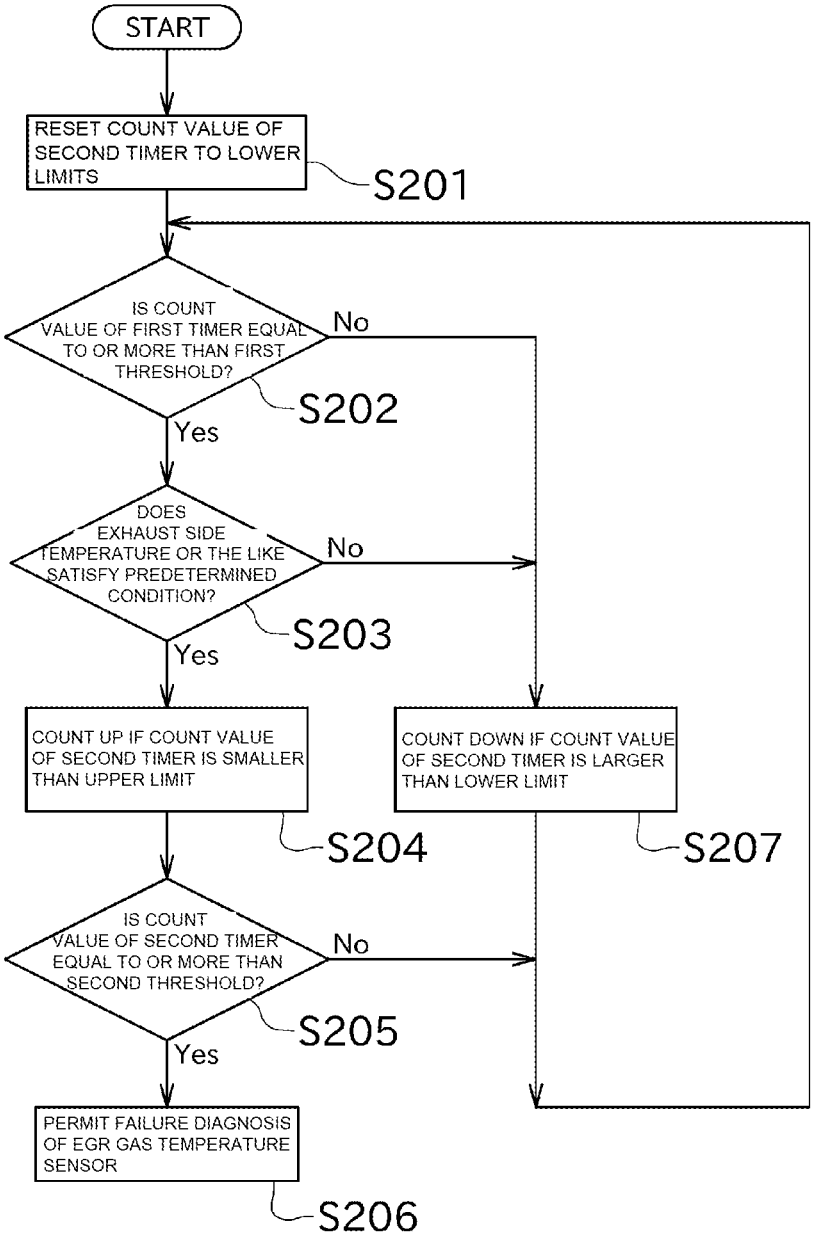
FIG. 4 is a flowchart illustrating processing related to a second timer.

FIG. 4 illustrates a flowchart related to processing of the second timer 57. A flow in FIG. 4 is started when the engine 1 is started. In addition, the flow in FIG. 4 is performed in parallel with the processing of the first timer 55 illustrated in FIG. 3.

First, the ECU 9 performs initialization processing with the count value of the second timer 57 as the lower limit (Step S201). In this embodiment, the lower limit of the count value of the second timer 57 is 0 and the upper limit is 65535 (similar to the first timer 55). In Step S201, the count value of the second timer 57 is reset to 0.

Next, the ECU 9 checks whether the count value of the first timer 55 described above is equal to or more than the predetermined first threshold (Step S202). The first threshold corresponds to a permission determination start threshold described later. The first threshold can be set arbitrarily but, for example, the first threshold can be set to 65535, which is the same as the upper limit.

If it is determined in Step S202 that the count value of the first timer 55 is equal to or more than the first threshold, the ECU 9 determines whether a predetermined condition regarding the exhaust side temperature or the like is satisfied (Step S203). This condition has been determined mainly with focus on an engine operation area, considering whether sufficiently high temperature EGR gas is supplied to the EGR pipe 41 at an appropriate flow rate for the abnormality diagnosis of the EGR gas temperature sensor 47. Details of this condition will be described later. If the condition is satisfied, the ECU 9 counts up the second timer 57 (Step S204). However, if the count value has already reached the upper limit (65535), the count-up will not be performed.

Thereafter, the diagnosis control unit 59 of the ECU 9 determines whether the count value of the second timer 57 is equal to or more than a predetermined second threshold (Step S205). The second threshold corresponds to a diagnostic permission threshold described later. The second threshold can be set arbitrarily and, for example, can be set to be a value that is a little smaller than the upper limit of 65535.

If it is determined in Step S205 that the count value of the second timer 57 is equal to or more than the second threshold, the diagnosis control unit 59 permits the diagnosis unit 53 to perform a diagnosis on whether the EGR gas temperature sensor 47 has a failure (Step S206). Thus, the diagnosis unit 53 performs a diagnosis of the EGR gas temperature sensor 47.

Note that the diagnosis control unit 59 prohibits an abnormality diagnosis from a start of the engine 1 until an abnormality diagnosis is permitted by Step S206. Therefore, until the count value of the second timer 57 reaches the second threshold, the diagnosis unit 53 waits in a standby state without performing an abnormality diagnosis.

If it is determined in Step S202 that the count value of the first timer 55 is lower than the first threshold, the ECU 9 counts down the second timer 57 (Step S207). Even if it is determined in Step S203 that the fuel injection amount or the like does not satisfy the predetermined condition, processing of Step S207 is performed. However, if the count value has already reached the lower limit (0), the count-down will not be performed. Thereafter, the process returns to Step S202.

Next, details of determination in Step S203 will be described.

Specifically, the predetermined conditions in Step S203 are satisfied when [1] a temperature detected by the exhaust side temperature detection unit 65 is equal to or more than a predetermined temperature, [2] the fuel injection amount is equal to or more than a predetermined fuel injection amount determined in accordance with the engine speed, and [3] the opening degree of the EGR valve 45 is equal to or more than a predetermined opening degree.

Figure 5:
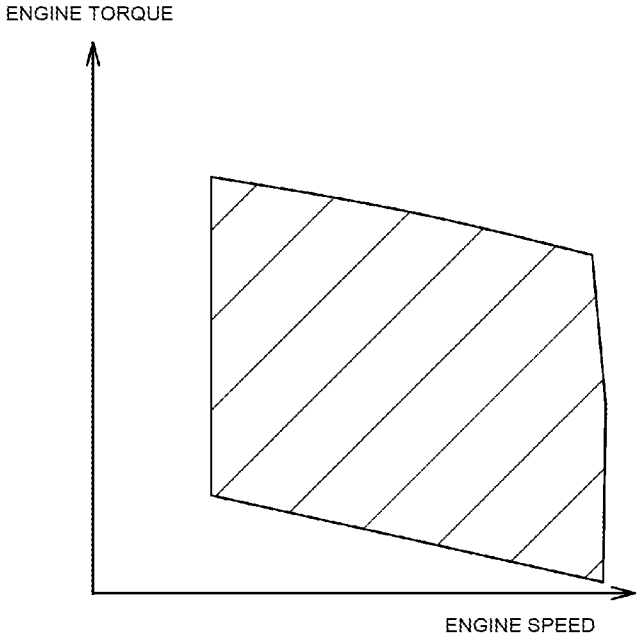
FIG. 5 is a chart illustrating predetermined conditions for the second timer to advance counting.

In FIG. 5, in the graph with an engine torque on the ordinate and an engine speed on the abscissa, the operating area in which the EGR gas temperature was found to be sufficiently high in the preliminary experiment is indicated by hatching. The above conditions [1] to [3] are determined in consideration of the operating condition falling within the above hatching area.

However, these conditions can be changed as appropriate as long as an EGR gas with a sufficiently high temperature for an abnormality diagnosis of the EGR gas temperature sensor 47 can be obtained at an appropriate flow rate. For example, it may be determined whether the conditions in Step S203 are satisfied based on only two factors, that is, the opening degree of the EGR valve 45 and the temperature detected by the exhaust side temperature detection unit 65.

As described above, in this embodiment, the condition of the opening degree of the EGR valve 45 and the condition of the temperature detected by the exhaust side temperature detection unit 65 are included as the predetermined conditions in Step S203. Thus, it is possible to perform an abnormality diagnosis of the EGR gas temperature sensor 47 in a situation where the temperature of the EGR gas is high and the flow rate of the flowing EGR gas is stable.

Figure 6:
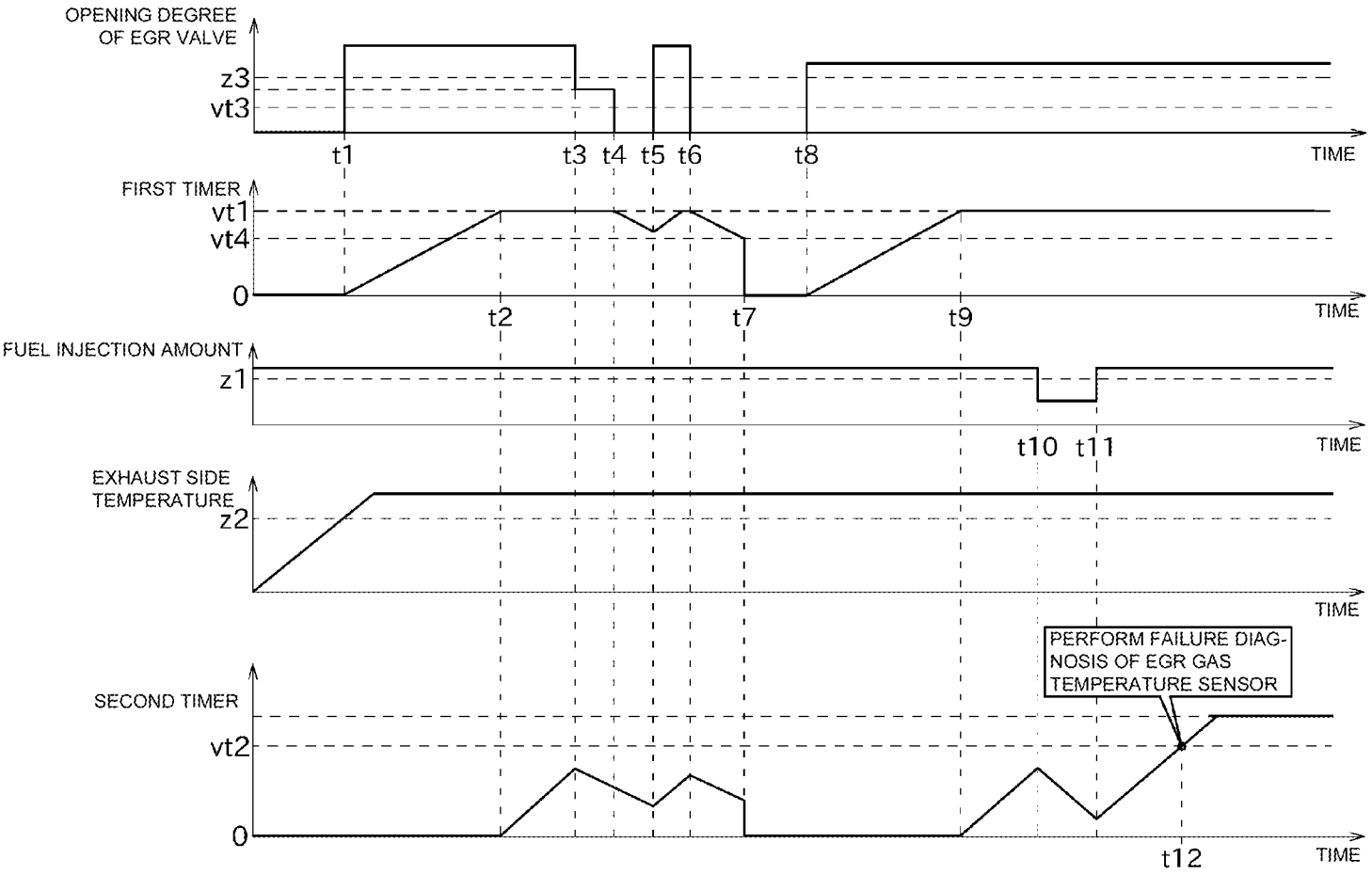
FIG. 6 is a time chart for diagnosis of the EGR gas temperature sensor.

Next, an example in which the count values of the first timer 55 and the second timer 57 change will be described using the graph of FIG. 6. FIG. 6 illustrates time transitions of the opening degree of the EGR valve 45, the count value of the first timer 55, the fuel injection amount, the exhaust side temperature detected by the exhaust side temperature detection unit 65, and the count value of the second timer 57 by five graphs arranged in an up-down direction. The abscissas of the graphs illustrated in FIG. 6 correspond to one another in the up-down direction.

Assume that, after the engine 1 is started, the EGR valve 45 in a fully closed state is significantly opened at a timing of t1. As a result, as the opening degree exceeds the predetermined open/close determination threshold (third threshold), the count value of the first timer 55 starts increasing from 0 at the timing of t1. As time elapses from the timing of t1, counting of the first timer 55 is repeated. The count value of the first timer 55 will increase, reflecting introduction of the EGR gas to the EGR tube 41 and progress of warm-up.

The EGR valve 45 continues to be open and, eventually, the count value of the first timer 55 reaches the upper limit at a timing of t2. This situation indicates that an area around the EGR gas temperature sensor 47 has been sufficiently warmed up in the EGR tube 41. The upper limit of the first timer 55 corresponds to the permission determination start threshold (first threshold) vt1 that is a condition for count-up of the second timer 57. In the timing of t2, the fuel injection amount is a predetermined injection amount z1 or more, the exhaust side temperature is a predetermined temperature z2 or more, and the opening degree of the EGR valve 45 is a predetermined opening z3 or more. Since the conditions in Step S202 and Step S203 are satisfied, the count value of the second timer 57 starts increasing from 0 at the timing of t2. As time elapses from the timing of t2, counting of the second timer 57 is repeated.

Next, assume that the opening degree of the EGR valve 45 changes to a closed side and falls below the predetermined opening z3 at a timing of t3 before the count value of the second timer 57 reaches the diagnostic permission threshold (second threshold) vt2. Since the conditions in Step S203 are no longer satisfied, the count value of the second timer 57 changes from an increase to a decrease at the timing of t3. As time elapses from the timing of t3, reverse counting of the second timer 57 is repeated.

Subsequently, assume that the opening degree of the EGR valve 45 is fully closed at a timing of t4 and the opening/closing determination threshold (third threshold) becomes vt3 or less. Along with this, the count value of the first timer 55 that has remained at the upper limit begins to decrease. As time elapses from the timing of t4, reverse counting of the first timer 55 is repeated. Thus, it is possible to reflect the cooling of the configuration around the EGR tube 41 to the count value of the first timer 55.

Assume that the EGR valve 45 is significantly opened at a timing of t5. Along with this, at the timing of t5, both the count value of the first timer 55 and the count value of the second timer 57 change from a decrease to an increase. Shortly before a timing of t6, the count value of the first timer 55 has reached the upper limit again.

Assume that, immediately thereafter, the EGR valve 45 is fully closed again at the timing of t6. At the timing of t6, the opening degree of the EGR valve 45 falls below the predetermined opening degree z3, and the opening/closing determination threshold is vt3 or less. Therefore, at the timing of t6, both the count values of the first timer 55 and the second timer 57 start decreasing.

When the EGR valve 45 continues to be fully closed, the count value of the first timer 55 falls below a predetermined reset threshold (fourth threshold) vt4 at a timing of t7. Then, at this timing, the count values of the first timer 55 and the second timer 57 are forcibly reset to 0. That is, the counts of the first timer 55 and the second timer 57 for the abnormality diagnosis are both restarted from beginning. Thus, a timing of the abnormality diagnosis of the EGR gas temperature sensor 47 will be delayed until a more stable situation is achieved. Therefore, diagnostic accuracy can be increased.

Assume that the EGR valve 45 in a fully closed state is significantly opened at a timing of t8. Since the opening degree exceeds the open/close determination threshold vt3, the count value of the first timer 55 starts increasing from 0 at the timing of t8.

The EGR valve 45 continues to be open and, eventually, the count value of the first timer 55 reaches the upper limit (in other words, the permission determination start threshold vt1) at a timing of t9. Similar to the timing of t2, in the timing of t9, the conditions in Steps S202 and S203 are satisfied. Therefore, the count value of the second timer 57 starts increasing from 0 at the timing of t9.

Assume that the fuel injection amount changes to the decreasing side and falls below the predetermined injection amount z1 at a timing of t10 before the count value of the second timer 57 reaches the diagnostic permission threshold vt2. Since the conditions in Step S203 are no longer satisfied, the count value of the second timer 57 changes from an increase to a decrease at the timing of t10.

Assume that, at a timing of t11, the fuel injection amount recovers to an original value and is the predetermined injection amount z1 or more again. Since the conditions in Step S203 are satisfied, the count value of the second timer 57 starts increasing at this timing.

Eventually, at a timing of t12, the count value of the second timer 57 reaches the diagnostic permission threshold vt2. At the timing of t12, the diagnosis unit 53 performs an abnormality diagnosis of the EGR gas temperature sensor 47.

In this embodiment, the second timer 57 can be a timer that ensures that an operating state or the like suitable for performing an abnormality diagnosis of the EGR gas temperature sensor 47 appears stably. Then, as a condition for the second timer 57 to count up, the count value of the first timer 55 needs to be equal to or more than a predetermined threshold (permission determination start threshold vt1), in other words, a sufficient time needs be taken to warm up the area around the EGR tube 41. Thus, it is possible to prevent an abnormality diagnosis from being performed when the warm air around the EGR tube 41 is insufficient, so that the accuracy of the abnormality diagnosis of the EGR gas temperature sensor 47 can be improved.

The second timer 57 performs reverse counting if even one of the above conditions [1] to [3] is not satisfied. In this case, speed of reverse counting (decrease rate of the count value from t10 to t11) when the fuel injection amount is less than the predetermined injection amount z1 is larger than speed of reverse counting (decrease rate of count value from t3 to t5) when the opening degree of the EGR valve is less than the predetermined opening z3. The fuel injection amount is important for sufficiently raising the temperature around the EGR gas temperature sensor 47. Therefore, by using timer count control that is sensitive to the fuel injection amount condition as described above, it is possible to perform an abnormality diagnosis with a good timing.

As described above, the engine 1 of this embodiment includes an EGR device 7 that recirculates a part of the exhaust gas to the intake side as an EGR gas. The engine 1 includes the engine body 3, the EGR tube 41, the EGR gas temperature sensor 47, the EGR valve 45, the EGR control unit 51, the EGR valve opening degree detection unit 63, the diagnosis unit 53, the first timer 55, the second timer 57, and the diagnosis control unit 59. The engine body 3 includes an exhaust passage and an intake passage. The EGR pipe 41 connects the exhaust passage and the intake passage so that the EGR gas can be distributed. The EGR gas temperature sensor 47 detects the temperature of the EGR gas flowing through the EGR tube 41. The EGR valve 45 can adjust the amount of EGR gas flowing through the EGR tube 41 by changing the opening degree. The EGR control unit 51 controls the opening degree of the EGR valve 45. The EGR valve opening degree detection unit 63 detects the opening degree of the EGR valve 45. The diagnosis unit 53 diagnoses whether the EGR gas temperature sensor 47 has a failure, based on the detected value of the EGR gas temperature sensor 47. The first timer 55 performs counting in accordance with passage of time when the EGR valve 45 is open. The second timer 57 performs counting in accordance with the passage of time when the count value of the first timer 55 is equal to or more than the preset permission determination start threshold vt1 and the predetermined conditions are satisfied. The diagnosis control unit 59 blocks the diagnosis by the diagnosis unit 53 when the count value of the second timer 57 is less than the preset diagnostic permission threshold vt2, and permits the diagnosis when the count value of the second timer 57 is equal to or more than the diagnostic permission threshold vt2.

Thus, by using the first timer 55 that indicates the degree of warm-up by the EGR gas for the configuration around the EGR gas temperature sensor 47 in the EGR tube 41, the EGR gas temperature sensor 47 can be diagnosed with an appropriate timing appropriately considering the time required for warm-up. In addition, by setting that the count value of the first timer 55 is equal to or more than the predetermined threshold as one of the conditions for counting of the second timer 57, it is possible to determine a diagnostic timing by considering various determination factors in a well-balanced manner. Therefore, a diagnosis of the EGR gas temperature sensor 47 can be performed accurately.

Further, the engine 1 of this embodiment includes the exhaust side temperature detection unit 65. The exhaust side temperature detection unit 65 is provided in the portion of the exhaust passage located on the upstream side of the connection portion with the EGR pipe 41 and is configured to detect the temperature of this upstream side portion. The predetermined conditions in Step S203 are based on at least the opening degree of the EGR valve 45 and the temperature detected by the exhaust side temperature detection unit 65.

Thus, a diagnosis of the EGR gas temperature sensor 47 can be performed in a state where the temperature of the EGR gas in the EGR tube 41 is high and the flow rate of the EGR gas is sufficient. Therefore, the accuracy of the diagnosis of the EGR gas temperature sensor 47 can be increased.

Furthermore, in the engine 1 of this embodiment, when the opening degree of the EGR valve 45 is equal to or less than the preset opening/closing determination threshold vt3, the first timer 55 performs reverse counting in accordance with the passage of time.

When the opening degree of the EGR valve 45 is equal to or less than the open/close determination threshold vt3, it means that the EGR valve 45 is in a fully closed state, but it may include a case where the EGR valve 45 is slightly open.

That is, if the EGR valve 45 is completely closed after the EGR tube 41 or the like is warmed up once, or if the opening degree is not sufficient even with the EGR valve 45 opened, the configuration around the EGR gas temperature sensor 47 is cooled in some cases. In this case, by rewinding the count value of the first timer 55, a diagnostic timing of the EGR gas temperature sensor 47 can be delayed by appropriately considering progress of reduction in temperature.

Furthermore, in the engine 1 of this embodiment, the reset threshold vt4 that is a value closer to 0 than the permission determination start threshold vt1 related to the first timer 55 is set. When the count value of the first timer 55 is closer to 0 than the reset threshold vt4, the count value of the first timer 55 is reset to 0 as illustrated by the timing of t7 in FIG. 6.

Thus, if a situation where the warm-up by the EGR gas is insufficient continues and the configuration around the EGR tube 41 has been cooled for a long time, it is considered that the warm-up has not been performed at all, and thus, a diagnosis of EGR gas temperature sensor 47 can be kept from being performed in a too early timing. On the other hand, when a short-time EGR cut that does not lower the temperature of the EGR gas is executed at the time of a predetermined change in an operating state of the engine 1 (for example, when accelerating or when a load is applied), it is possible to prevent the diagnostic timing of the EGR gas temperature sensor 47 from being excessively delayed.

Furthermore, in the engine 1 of this embodiment, when the count value of the first timer 55 is a value closer to 0 than the reset threshold vt4, as illustrated by the timing of t7 in FIG. 6, the count value of the second timer 57 is reset to 0.

Thus, if a situation where the warm-up by the EGR gas is insufficient continues and the configuration around the EGR tube 41 has been cooled for a long time, it is considered that a situation where predetermined conditions for a diagnosis of the EGR gas temperature sensor 47 are satisfied did not appear at all, and thus, it is possible to wait in a standby state without performing a diagnosis of the EGR gas temperature sensor 47 until a stable situation is achieved. On the other hand, in the case of the short-time EGR cut, or the like, it is possible to prevent the diagnostic timing of the EGR gas temperature sensor 47 from being excessively delayed.

Furthermore, in the engine 1 of this embodiment, in order to satisfy the predetermined conditions in Step S203, the opening degree of the EGR valve 45 needs to be the predetermined opening degree z3 or more and the fuel injection amount needs to be the predetermined injection amount z1 or more. In the first case (from t3 to t5 in FIG. 6) where the opening degree of the EGR valve 45 is less than the predetermined opening degree z3 and the fuel injection amount is equal to or more than the predetermined injection amount z1, the second timer 57 performs reverse counting in accordance with the passage of time. In the second case (from t10 to t11) where the opening degree of the EGR valve 45 is the predetermined opening degree z3 or more and the fuel injection amount is less than the predetermined injection amount z1, the second timer 57 performs reverse counting in accordance with the passage of time. The change rate of the count value of the second timer 57 in the second case is larger than the change rate of the count value of the second timer 57 in the first case.

Thus, when the fuel injection amount condition is not satisfied, the count value of the second timer 57 is rewound relatively larger than when the EGR valve opening degree condition is not satisfied. Therefore, it is possible to determine a diagnostic timing of the EGR gas temperature sensor 47 with emphasis on the fuel injection amount that is important for increasing the accuracy of the abnormality diagnosis of the EGR valve 45.

Although a preferred embodiment of the present invention has been described, the configurations as described above can be modified as stated below, for example.

The first timer 55 has an initial value of 0 and is configured as a count-up timer that counts up from 0. Instead of this, the initial value may be set to an appropriate value (for example, 65535), and the first timer 55 may be configured as a count-down timer that counts down from this value. The second timer 57 may be also configured as a count-down timer. In the case of the count-down timer, normal counting is count-down and reverse counting is count-up.

A range and the initial value of each of possible count values of the first timer 55 and the second timer 57 can be changed as appropriate. The above described first to fourth thresholds can be also changed as appropriate in accordance with circumstances.

The reverse counting processing of the first timer 55 may be omitted.

The processing of forcibly resetting the count values of the first timer 55 and the second timer 57 can be omitted as appropriate.

In the example of FIG. 6, after the exhaust side temperature exceeds the predetermined temperature, the exhaust side temperature does not fall below the predetermined temperature even once. However, for some reasons, the exhaust side temperature may fall below the predetermined temperature. In this case, in accordance with the flowchart of FIG. 4, the second timer 57 performs count-down (reverse counting). However, the count value of the second timer 57 may be reset to 0 immediately.

The speed of reverse counting when the fuel injection amount is less than the predetermined injection amount z1 may be equal to the speed of reverse counting when the opening degree of the EGR valve is less than the predetermined opening degree z3.

Considering the above-described teachings, it is clear that the present invention can take many changes and modifications. Therefore, it should be understood that the present invention may be practiced in a manner other than that described herein within the scope of the appended claims.

DESCRIPTION OF REFERENCE NUMERALS

1 engine
3 engine body
7 EGR device
41 EGR pipe (EGR passage)
45 EGR valve
47 EGR gas temperature sensor
51 EGR control unit
53 diagnosis unit
55 first timer
57 second timer
59 diagnosis control unit
63 EGR valve opening degree detection unit
65 exhaust side temperature detection unit

The invention claimed is:

1. An engine including an EGR device that recirculates a part of an exhaust gas to an intake side as an EGR gas, the engine comprising:

an engine body including an exhaust passage and an intake passage;

an EGR passage connecting the exhaust passage and the intake passage so that the EGR gas can be distributed;

an EGR gas temperature sensor that detects a temperature of the EGR gas flowing through the EGR passage;

an EGR valve that can adjust an amount of the EGR gas flowing through the EGR passage by changing an opening degree;

an EGR control unit that controls the opening degree of the EGR valve;

an EGR valve opening degree detection unit that detects the opening degree of the EGR valve;

a diagnosis unit that diagnoses whether the EGR gas temperature sensor has a failure, based on a value detected by the EGR gas temperature sensor;

a first timer that performs counting in accordance with passage of time when the EGR valve is open;

a second timer that performs counting in accordance with the passage of time when a count value of the first timer is equal to or more than a preset first threshold and predetermined conditions are satisfied; and a diagnosis control unit that blocks a diagnosis by the diagnosis unit when a count value of the second timer is less than a preset second threshold and permits the diagnosis when the count value of the second timer is equal to or more than the second threshold.

2. The engine according to claim 1, further comprising:

an exhaust side temperature detection unit that detects an internal temperature of a portion of the exhaust passage on an upstream side of a connection portion with the EGR passage, wherein the predetermined conditions are based on at least the opening degree of the EGR valve and the temperature detected by the exhaust side temperature detection unit.

3. The engine according to claim 1, wherein, when the opening degree of the EGR valve is equal to or less than a preset third threshold, the first timer performs reverse counting in accordance with the passage of time.

4. The engine according to claim 3, wherein, when the opening degree of the EGR valve is equal to or less than the third threshold, the EGR valve is fully closed.

5. The engine according to claim 3, wherein a fourth threshold that is a value closer to an initial value of the first timer than the first threshold related to the first timer is set, and when the count value of the first timer is a value closer to the initial value than the fourth threshold, the count value of the first timer is returned to the initial value.

6. The engine according to claim 5, wherein, when the count value of the first timer is a value closer to the initial value than the fourth threshold, the count value of the second timer is returned to an initial value of the second timer.

7. The engine according to claim 1, wherein, in order to satisfy the predetermined conditions, it is necessary at least that the opening degree of the EGR valve is equal to or more than a predetermined opening degree and a fuel injection amount is equal to or more than a predetermined injection amount, in a first case where the opening degree of the EGR valve is less than the predetermined opening degree and the fuel injection amount is equal to or more than the predetermined injection amount, the second timer performs reverse counting in accordance with the passage of time, in a second case where the opening degree of the EGR valve is equal to or more than the predetermined opening degree and the fuel injection amount is less than the predetermined injection amount, the second timer performs reverse counting in accordance with the passage of time, and a change rate of the count value of the second timer in the second case is larger than a change rate of the count value of the second timer in the first case.

* * * * *